US007631499B2

(12) United States Patent
Bland

(10) Patent No.: US 7,631,499 B2
(45) Date of Patent: Dec. 15, 2009

(54) AXIALLY STAGED COMBUSTION SYSTEM FOR A GAS TURBINE ENGINE

(75) Inventor: Robert J. Bland, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 180 days.

(21) Appl. No.: 11/498,480

(22) Filed: Aug. 3, 2006

(65) Prior Publication Data

US 2009/0272116 A1 Nov. 5, 2009

(51) Int. Cl.
*F23R 3/42* (2006.01)

(52) U.S. Cl. ..... 60/747; 60/740; 431/278

(58) Field of Classification Search ..... 60/740, 60/746, 747, 804; 431/8, 278, 284, 285, 431/353

See application file for complete search history.

(56) References Cited

U.S. PATENT DOCUMENTS

| | | | | |
|---|---|---|---|---|
| 2,565,843 | A * | 8/1951 | Dennison | 60/747 |
| 3,971,209 | A | 7/1976 | de Chair | |
| 4,292,801 | A * | 10/1981 | Wilkes et al. | 60/776 |
| 5,054,280 | A * | 10/1991 | Ishibashi et al. | 60/776 |
| 5,876,860 | A * | 3/1999 | Marijnissen et al. | 428/623 |
| 5,943,866 | A | 8/1999 | Lovett et al. | |
| 6,047,550 | A | 4/2000 | Beebe | |
| 6,082,111 | A | 7/2000 | Stokes | |
| 6,164,055 | A | 12/2000 | Lovett et al. | |
| 6,311,471 | B1 | 11/2001 | Waldherr et al. | |
| 6,311,473 | B1 | 11/2001 | Benjamin et al. | |
| 6,460,343 | B1 | 10/2002 | Rakhmailov | |
| 6,619,026 | B2 | 9/2003 | Carelli et al. | |
| 6,672,070 | B2 | 1/2004 | Bland et al. | |
| 6,786,047 | B2 | 9/2004 | Bland et al. | |
| 6,793,831 | B1 | 9/2004 | Paul et al. | |
| 7,021,562 | B2 | 4/2006 | Mansour et al. | |
| 7,028,483 | B2 | 4/2006 | Mansour et al. | |
| 2003/0106321 | A1 | 6/2003 | Von Der Bank | |
| 2004/0045295 | A1 | 3/2004 | Wiebe et al. | |
| 2005/0016178 | A1 | 1/2005 | Wasif et al. | |
| 2005/0028526 | A1 | 2/2005 | Von Der Bank | |
| 2005/0084812 | A1 | 4/2005 | Rakhmailov et al. | |
| 2006/0034689 | A1 | 2/2006 | Taylor et al. | |
| 2007/0017225 | A1 | 1/2007 | Bancalari et al. | |

OTHER PUBLICATIONS

Norman Chigier, The Future of Atomization and Sprays, Department of Mechanical Engineering, Carnegie Mellon University, Pittsburgh, Pennsylvania, USA, Sep. 2005.

* cited by examiner

*Primary Examiner*—Devon C Kramer
*Assistant Examiner*—Philip Stimpert

(57) ABSTRACT

An axially staged combustion system is provided for a gas turbine engine comprising a main body structure having a plurality of first and second injectors. First structure provides fuel to at least one of the first injectors. The fuel provided to the one first injector is adapted to mix with air and ignite to produce a flame such that the flame associated with the one first injector defines a flame front having an average length when measured from a reference surface of the main body structure. Each of the second injectors comprising a section extending from the reference surface of the main body structure through the flame front and having a length greater than the average length of the flame front. Second structure provides fuel to at least one of the second injectors. The fuel passes through the one second injector and exits the one second injector at a location axially spaced from the flame front.

14 Claims, 4 Drawing Sheets

AXIALLY STAGED COMBUSTION SYSTEM FOR A GAS TURBINE ENGINE

This invention was made with U.S. Government support under DE-FC26-05NT42644 awarded by the U.S. Department of Energy. The U.S. Government has certain rights to this invention.

This application is related to U.S. patent application Ser. No. 11/498,479 entitled "AT LEAST ONE COMBUSTION APPARATUS AND DUCT STRUCTURE FOR A GAS TURBINE ENGINE," which is filed concurrently herewith and hereby incorporated by reference herein.

FIELD OF THE INVENTION

The present invention is directed to an axially staged combustion system for a gas turbine engine.

BACKGROUND OF THE INVENTION

Gas combustion turbine engines are used for generating power in a variety of applications including land-based electrical power generating plants. Gas turbine engines are known to produce an exhaust stream containing a number of combustion products. Many of these byproducts of the combustion process are considered atmospheric pollutants. Of particular concern is the production of the various forms of nitrogen oxides collectively known as $NO_x$. It is known that $NO_x$ emissions from a gas turbine increase significantly as the maximum combustion temperature rises in a combustor of the gas turbine engine as well as the residence time for the reactants at the maximum combustion temperature within the combustor.

U.S. Pat. No. 6,047,550 discloses an axially staged combustion system for a gas turbine engine. It comprises a premixed combustion assembly and a secondary fuel injection assembly located downstream from the premixed combustion assembly. The premixed assembly comprises start-up fuel nozzles and premixing fuel nozzles. The secondary fuel injection assembly illustrated in FIG. 2 of the '550 patent includes eight fuel/air injection spokes, with each spoke having a plurality of orifices. Mixing of the fuel provided by the secondary fuel injection assembly is believed to be limited due to the small number of fuel/air injection spokes and orifices provided in those spokes. Limited mixing of fuel with air may result in rich fuel zones causing high temperature combustion zones, e.g., 2000 degrees C. and, hence, excessive $NO_x$ emissions.

SUMMARY OF THE INVENTION

In accordance with a first aspect of the present invention, an axially staged combustion system for a gas turbine engine is provided. The system comprises a main body structure having a plurality of first injectors and a plurality of second injectors, first structure to provide fuel to at least one of the first injectors, and second structure to provide fuel to at least one of the second injectors. The fuel provided to the at least one of the first injectors is adapted to mix with air and ignite to produce a flame such that the flame associated with the at least one of the first injectors defines a flame front having an average length when measured from a reference surface of the main body structure. Each of the second injectors may comprise a section extending from the reference surface of the main body structure through the flame front and have a length greater than the average length of the flame front. The fuel passing through the at least one of the second injectors may exit the at least one of the second injectors at a location axially spaced from the flame front such that the fuel exiting the at least one of the second injectors mixes with air and ignites at a location axially spaced from the flame front.

The main body structure may comprise a main body unit having a plurality of first passages defining the first injectors and a plurality of second passages. An outer surface of the main body unit may define the reference surface of the main body structure. Preferably, a plurality of tubes are associated with the second passages, such that corresponding sets of the tubes and the second passages define the second injectors.

Each of the first and second passages may have a diameter of from about 0.5 cm to about 2 cm.

The main body unit may be formed from a nickel-based material.

A ratio of the first passages to the second passages may be from about 2/1 to about 6/1.

Each first passage in a set of the first passages has a first center axis and a first diameter and one of the second passages positioned adjacent to the set of first passages has a second center axis and a second diameter. A distance between the first and second center axes may be within a range of about two times the first diameter to about four times the first diameter.

The axially staged combustion system may further comprise cooling structure to cool the tubes of the second injectors.

The second structure preferably provides fuel to the at least one of the second injectors concurrently with the first structure providing fuel to the at least one of the first injectors.

The first structure preferably provides fuel to two or more of the first injectors and the second structure preferably provides fuel to two or more of the second injectors.

A first one of the second injector sections may have a first length and a second one of the second injector sections may have a second length which is different from the first length.

A first one of the second injectors may have a first diameter and a second one of the second injectors may have a second diameter different from the first diameter.

The second structure may provide fuel to the at least one of the second injectors at a rate such that the fuel mixes with air to create a fuel and air mixture richer than a fuel and air mixture resulting from a rate at which fuel is provided to the at least one of the first injectors by the first structure.

In accordance with a second aspect of the present invention, an axially staged combustion system is provided for a gas turbine engine. It comprises a plurality of first injectors, a plurality of second injectors position adjacent to the first injectors, first structure to provide fuel to at least one of the first injectors, and second structure to provide fuel to at least one of the second injectors. The fuel provided to the at least one of the first injectors is adapted to mix with air provided to the at least one of the first injectors and ignite to produce a flame such that the flame associated with the at least one of the first injectors defines a flame front. Each of the second injectors may extend axially through and beyond the flame front. Fuel passes through the at least one of the second injectors and exits the at least one of the second injectors at a location axially spaced from the flame front such that the fuel exiting the at least one of the second injectors ignites at a location axially spaced from the flame front.

DETAILED DESCRIPTION OF THE INVENTION

Figure 1:
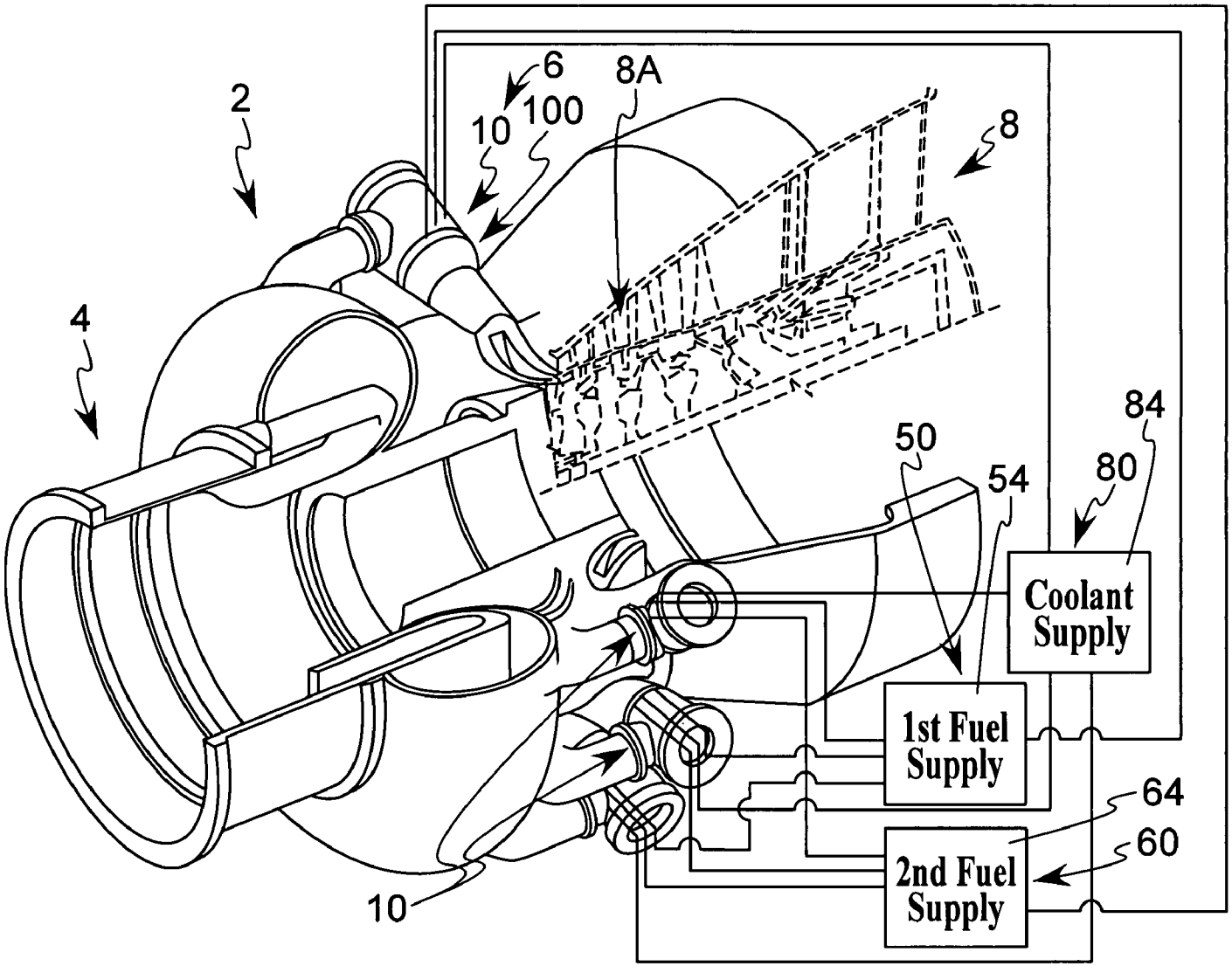
FIG. 1 is a perspective view of a gas turbine engine illustrating in phantom a portion of internal structure of a turbine and in solid line a combustor with a portion of the combustor removed and wherein the combustor includes a plurality of axially staged combustion systems formed in accordance with the present invention.

Referring now to FIG. 1, a gas turbine engine 2 is illustrated including a plurality of axially staged combustion systems 10 formed in accordance with the present invention. The engine 2 includes a compressor 4 for compressing air, a combustor 6 for producing hot combustion products or gases by burning fuel in the presence of the compressed air produced by the compressor 4, and a turbine 8 having a rotor 8A comprising a plurality of axially spaced-apart blade assemblies for receiving and being rotated by the hot combustion products produced in the combustor 6. The combustor 6 includes the plurality of axially staged combustion systems 10. The fuel may comprise, for example, natural or synthetic gas or hydrogen. The internal structure of the compressor 4 is not shown.

Since each of the combustion systems 10 forming part of the gas turbine engine combustor 6, illustrated in FIG. 1, may be constructed in the same manner, only one combustion system 10 will be described in detail herein.

Figure 2A:
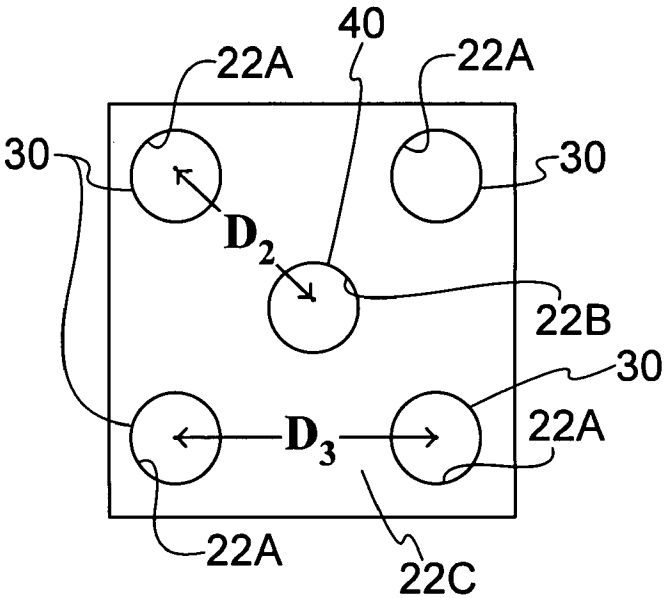
FIG. 2A is an enlarged portion of the main body structure illustrated in FIG. 2.
Figure 2:
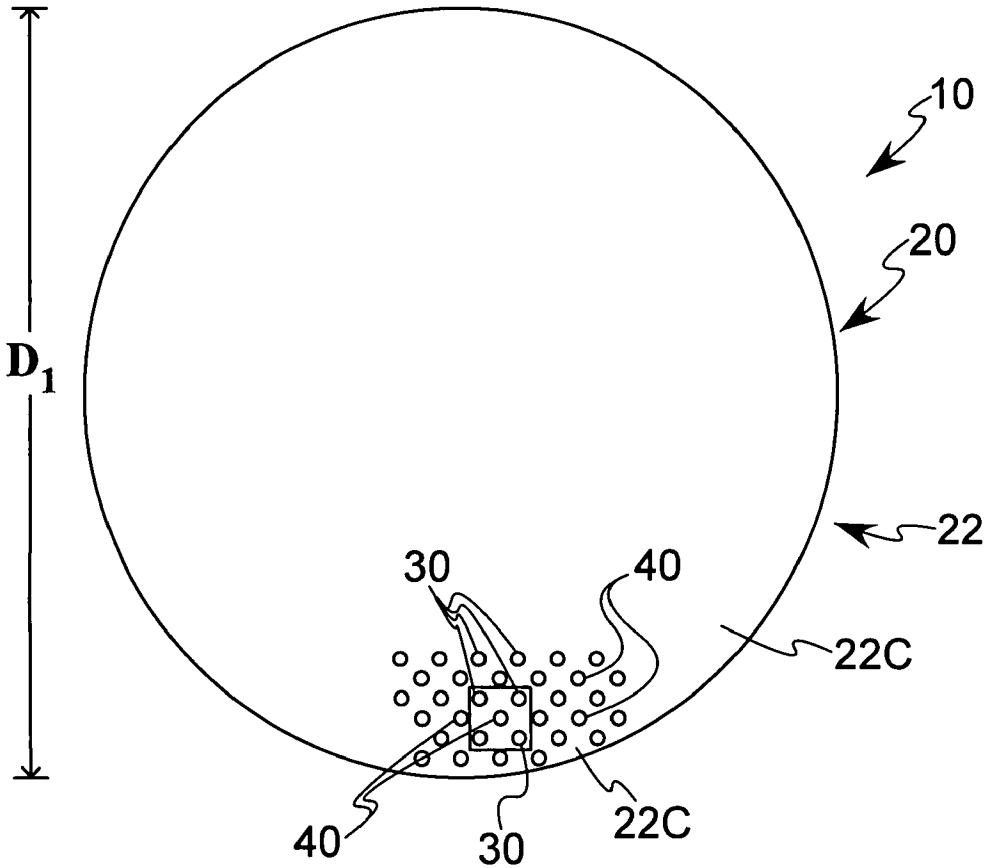
FIG. 2 is a plan view of a main body structure of an axially staged combustion system formed in accordance with the present invention.
Figure 3:
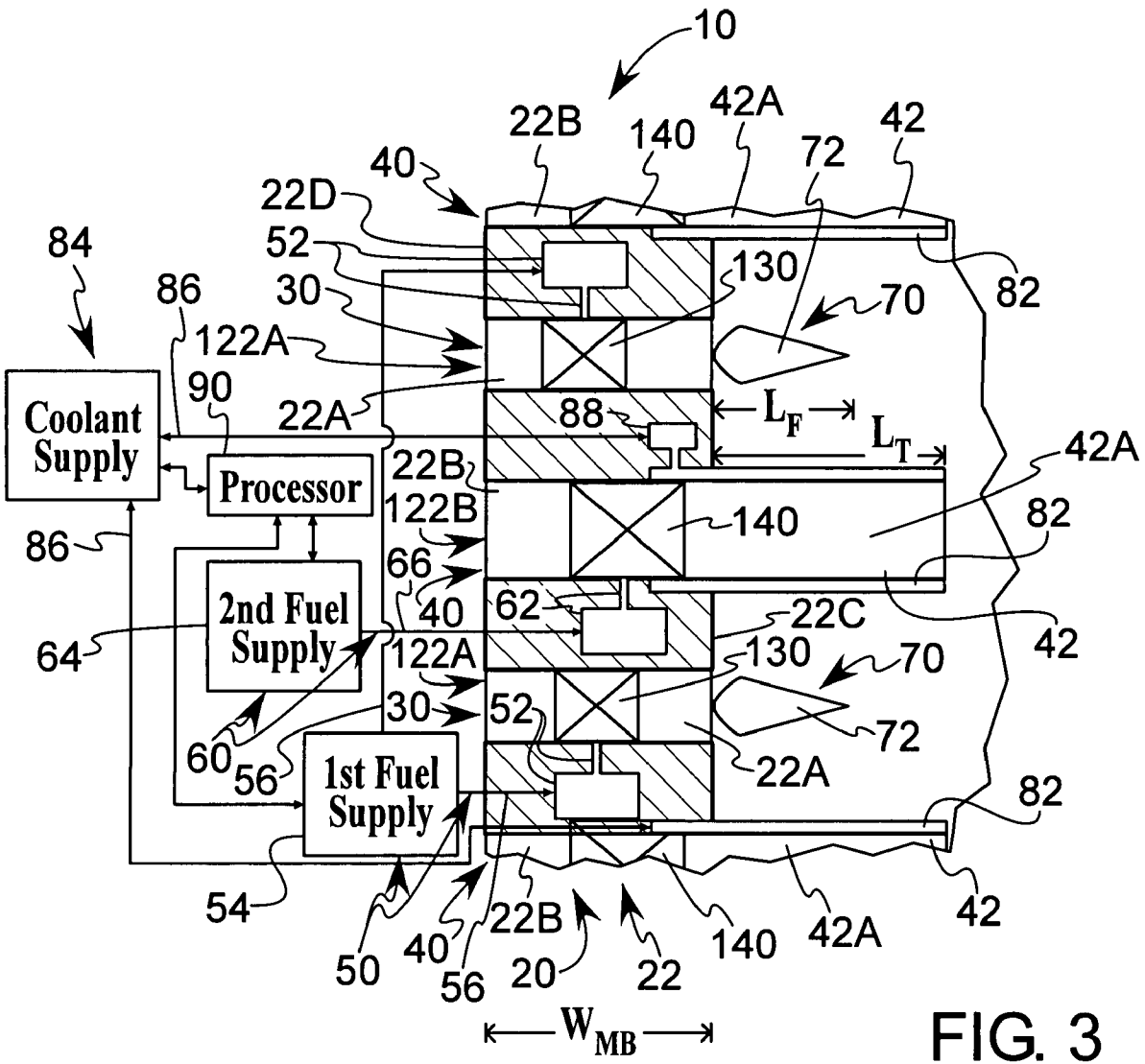
FIG. 3 is a schematic cross sectional view of a portion of the main body structure illustrated in FIG. 2 and including schematic representations of first and second fuel supplies and a coolant supply.

The combustion system 10 comprises a main body structure 20 including a plurality of first injectors 30 and a plurality of second injectors 40, see FIGS. 2, 2A and 3. The main body structure 20 may be formed from a nickel-based material using a macrolamination process, which process is commercially available from Parker-Hannifin Corporation. The combustion system 10 further comprises first and second fuel feed structures 50 and 60, respectively, see FIGS. 1 and 3. The first fuel feed structure 50 provides fuel to the first injectors 30, while the second fuel feed structure 60 provides fuel to the second injectors 40.

In the illustrated embodiment, the main body structure 20 comprises a main body unit 22 having a plurality of first passages 22A defining the first injectors 30 and a plurality of second passages 22B, see FIG. 3. The main body unit 22 has a circular shape, including circular first and second outer surfaces 22C and 22D, and a diameter $D_1$ of from about 20 cm to about 60 cm, see FIGS. 2 and 3. The main body unit 22 also has a width $W_{MB}$ of from about 2 cm to about 10 cm, see FIG. 3. It is noted that the shape of the main body unit 22 is not required to be circular and may be square, rectangular, or any other geometric shape.

The first and second passages 22A and 22B extend completely through the main body unit 22, see FIG. 3. Each of the first and second passages 22A and 22B may be circular in cross section. The first passages 22A have a first diameter of from about 0.5 cm to about 2 cm and the second passages 22B have a second diameter of from about 0.5 cm to about 2 cm. In an embodiment a ratio of the diameter of at least one of the second passages 22B to the diameter $D_1$ of the main body unit 22 is in a range from about 10:1 to about 120:1. In another embodiment a ratio of the diameter of at least one of the second passages 22B to the diameter $D_1$ of the main body unit 22 is in a range from about 20:1 to about 50:1. In yet another embodiment a ratio of the diameter of at least one of the second passages 22B to the diameter $D_1$ of the main body unit 22 is in a range from about 30:1 to about 40:1. A distance $D_2$ between center axes of adjacent first and second passages 22A and 22B may fall within a range of from about two times the first diameter of a first passage 22A and about four times the first diameter of the first passage 22A. A distance $D_3$ between center axes of adjacent first passages 22A may be from about two times the first diameter of a first passage 22A and about four times the first diameter of the first passage 22A, see FIG. 2A. A ratio of the first passages 22A to the second passages 22B may be from about 2/1 to about 6/1. It is noted that two or more of the first passages 22A may have different diameters, two or more of the second passages 22B may have different diameters, and/or at least one of the first passages 22A may have a diameter different from the diameter of at least one of the second passages 22B. It is also noted that the cross sectional shape of the first and second passages 22A and 22B is not required to be circular and may be square, rectangular, or any other geometric shape.

Each of the second injectors 40 is defined by a second passage 22B and a corresponding tube 42, see FIG. 3. It is contemplated that the tubes 42 may be formed integral with the main body unit 22 or comprise separate tubular elements inserted into the second passages 22B. In either case, the tubes 42 have a section 42A extending from the first outer surface 22C (also referred to herein as the "reference surface") of the main body unit 22 and through a flame front 70 defined by flames 72 resulting from the combustion of fuel and air passing through the first injectors 30. Preferably, the tube sections 42A have a length $L_T$, as measured from the first outer surface 22C, greater than an average length $L_F$ of the flame front 70 so as to allow fuel to exit the second injectors 40 without immediately combusting. The tube section length $L_T$ should exceed the average length $L_F$ of the flame front by an amount sufficient to prevent immediate combustion of the fuel exiting the second injectors 40. For example, when the first passages 22A have a first diameter of from about 0.5 cm to about 2 cm, it is contemplated that the flame front 70 will have an average length $L_F$, when measured from the outer surface 22C, of from about 1 cm to about 6 cm. In this example, it is believed that the tube sections 42A should have a length of from about 2 cm to about 10 cm so as to extend beyond the average length $L_F$ of the flame front 70 by between about 1 cm to about 4 cm.

Figure 3A:
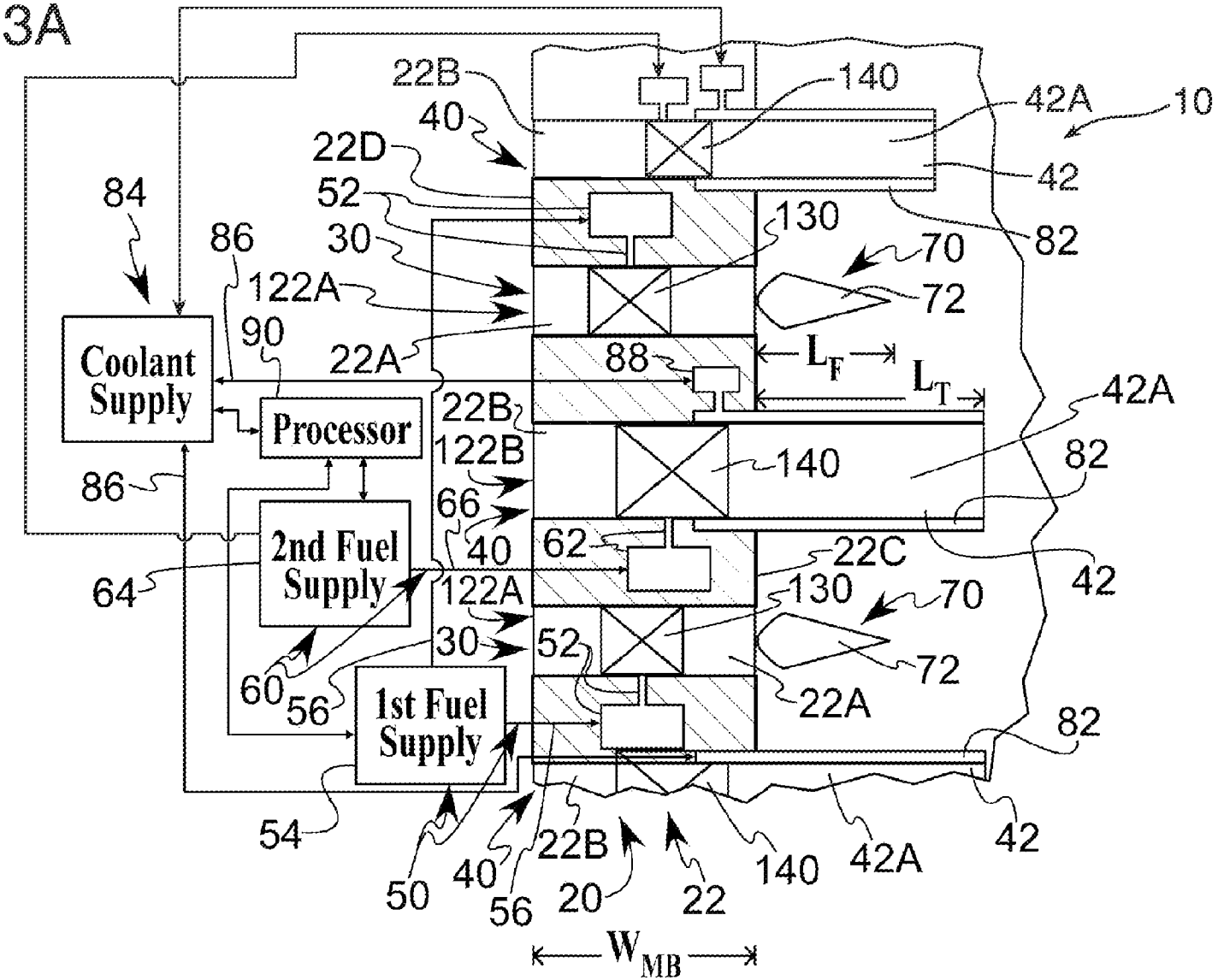
FIG. 3A is a view similar to FIG. 3 illustrating a further embodiment of the present invention.

It is noted that a section 42A of a first tube 42 may have a length which differs from a length of a section 42A of a second tube 42, see FIG. 3A. In any event, it is preferred that the lengths of the first and second tube sections be greater than the average length $L_F$ of the flame front 70.

The first fuel feed structure 50 comprises a plurality of first passageways 52 formed in the main body unit 22. At least one first passageway 52 communicates with each first passage 22A so as to provide a path for fuel to enter each first passage 22A. A first fuel supply 54 provides fuel to the first passageways 52 via one or more fuel lines 56. A processor 90 is coupled to the first fuel supply 54 to control the rate at which fluid is supplied to the first passages 22A.

The second fuel feed structure 60 comprises a plurality of second passageways 62 formed in the main body unit 22. At least one second passageway 62 communicates with each second passage 22B so as to provide a path for fuel to enter the second passage 22B. A second fuel supply 64 provides fuel to the second passageways 62 via one or more fuel lines 66. The processor 90 is coupled to the second fuel supply 64 to control the rate at which fluid is supplied to the second passages 22B.

An inlet 122A into each first passage 22A and an inlet 122B into each second passage 22B define entrances through which compressed air from the compressor 4 of the gas turbine engine 2 enters the first and second injectors 30 and 40, see FIG. 3.

A first swirler 130 is provided in each first injector 30 and a second swirler 140 is provided in each second injector 40, see FIG. 3. Each of the first and second swirlers 130 and 140 comprises one or more conventional swirler vanes, which vanes function to generate air turbulence to mix the compressed air from the compressor 4 with the fuel from the fuel feed structures 50, 60. The first and second swirlers 130 and 140 may be formed as an integral part of the main body unit 22 or comprise separate elements inserted into the passages 22A, 22B.

The combustion system 10 may further comprise cooling structure 80 to cool the tubes 42 of the second injectors 40. In the illustrated embodiment, the cooling structure 80 comprises a sleeve 82 positioned about each tube 82, which is adapted to receive a coolant, such as steam, air or another fluid, from a coolant supply 84 via coolant lines 86 and passageways 88 formed in the main body unit 22. The cooling structure 80 is illustrated as a closed system such that the fluid supplied to the sleeves 82 returns to the coolant supply 84. However, the coolant supply 84 may supply steam, air or another fluid which exits the sleeves 82 through orifices (not shown) provided in the sleeves 82. Operation of the coolant supply 84 is actively controlled by the processor 90 or passively controlled by the dimensions of the orifices in the sleeves 82.

Operation of the axially staged combustion system 10 will now be described. Compressed air generated by the compressor 4 enters the inlets 122A, 122B into the first and second passages 22A, 22B. During low and mid-range operation of the gas turbine engine 2, fuel may only be provided to the first passages 22A via operation of the first fuel feed structure 50. The fuel and compressed air in the first passages 22A are caused to mix via the first swirlers 130. The fuel and compressed air mixture leave the first injectors 30 and ignite resulting in flames 72 defining a flame front 70 having length $L_F$, see FIG. 3. A conventional ignition system (not shown) is provided near the first injectors 30 for igniting the fuel and compressed air exiting the first injectors. Preferably, the fuel is provided to the first injectors 30 at a rate, as controlled by the processor 90 and first fuel feed structure 50, so that it mixes with compressed air to create a mixture sufficiently lean such that the temperature of the resulting combustion products or gases is sufficiently low not to produce a significant amount of $NO_x$ emissions.

During high gas turbine engine operating conditions, fuel may be provided to both the first and second passages 22A, 22B via the first and second fuel feed structures 50 and 60. The fuel and compressed air in the first passages 22A are caused to mix via the first swirlers 130. The fuel and compressed air mixture leaving the first injectors 30 ignite resulting in flames 72 defining the flame front 70. The fuel and compressed air in the second passages 22B are caused to mix via the second swirlers 140. The fuel and compressed air mixture leaving the second injectors 40 auto-ignite downstream from the second injector tubes 42 in a common combustion chamber of the main body unit 22. As noted above, it is preferred that the second injector tubes 42 have a sufficient length so that the fuel and compressed air mixture leaving those tubes 42 exits a sufficient distance downstream from the flame front 70 such that the mixture does not immediately ignite after leaving the second injector tubes 42, but, rather, auto-ignites in the common combustion chamber of the main body unit 22 at a location axially spaced or downstream from the flame front 70 and the second injector tubes 42.

It is contemplated that the fuel and air mixture provided to the second injectors 40, as controlled by the processor 90 and second fuel feed structure 60, may be richer than the mixture provided to the first injectors 30 so as to raise the overall temperature of all gases downstream from the second injector tubes 42. Hence, the temperature of the combustion products or gases downstream from the second injector tubes 42 will likely be greater than the temperature of the combustion products or gases resulting from the combustion of only the fuel and air mixture exiting the first injectors 30 and located prior to the exits of the second injector tubes 42. However, it is believed that the total residence time that the combustion products or gases, located downstream from the second injector tubes 42, will be at the higher temperatures, until cooling occurs at a first row of blades in the turbine 8, will be sufficiently small that the resulting $NO_x$ emissions will occur at manageable rate.

In accordance with the present invention, the second injectors 40 are interspersed with the first injectors 30, such that the second injector tubes 42 extend through and beyond the flame front 70, see FIG. 3. Because the second injectors 40 are interspersed and positioned near the first injectors 30, i.e., the main body unit 22 is provided with a high density of first and second passages 22A, 22B, the fuel provided to the second injectors 40 is able to more fully mix with the compressed air provided to the second injectors 40 as well as remaining air from the first injectors 30. Hence, the number of rich fuel zones downstream from the second injector tubes 42 is reduced, which results in reduced $NO_x$ emissions.

Because the first diameters of the first passages 22A are small, the average length $L_F$ of the flame front 70 is short. The second injectors 40 are able to be positioned near and interspersed with the first injectors 30 because the average length $L_F$ of the flame front 70 is so small. A long average flame front length $L_F$ would require long second injector tubes 42, which may be difficult to implement in a practical and cost effective manner.

As illustrated in FIG. 1, a nozzle 100 defined, for example, by a cone, may be coupled to each main body structure 20 of each axially staged combustion system 10 for receiving, accelerating and cooling the combustion products emitted by each system 10. The nozzle 100 may have a ratio of an exit cross sectional area to an entrance cross sectional area of from about 1:2 to about 1:6 and preferably about 1:4. The nozzle 100 may be formed from an oxide system ceramic matrix composite or a conventional turbine superalloy.

It is contemplated that only fuel or only fuel and a diluent such as steam may be provided to the second injectors 40. Hence, in this embodiment, compressed air will not enter the second passages 22B. Also, second swirlers 140 will not be provided in the second passages 22B.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An axially staged combustion system for a gas turbine engine comprising:

a main body structure having a plurality of first injectors and a plurality of second injectors, compressed air being provided to said first injectors;

first structure to provide fuel to each of said first injectors, said fuel provided to said first injectors being adapted to mix with the compressed air provided to said first injectors and ignite to produce a flame such that the flame associated with said first injectors defines a flame front that is axially spaced from a reference surface of said main body structure;

each of said second injectors comprising a section extending from said reference surface of said main body structure and positioned such that fuel or a combination of air and fuel exits said second injectors axially downstream from a first axial location where a mixture of compressed air and fuel exits said first injectors, wherein the first axial location is at the reference surface;

second structure to provide fuel to each of said second injectors, said fuel passing through said second injectors and exiting each of said second injectors at a second axial location downstream of the first axial location such that said fuel exiting each of said second injectors mixes with air and ignites at a third axial location downstream of the second axial location, wherein said fuel from each of said second injectors is ignited in a common flame chamber defined in said main body structure;

wherein said second structure provides fuel to said second injectors at a positive rate such that said fuel mixes with air to create a fuel and air mixture richer than a fuel and air mixture resulting from a positive rate at which fuel is provided to said first injectors by said first structure; and wherein said main body structure comprises a main body unit having a plurality of first passages defining said first injectors and a plurality of second passages, an outer surface of said main body unit defining said reference surface of said main body structure, and a plurality of tubes associated with said second passages, corresponding sets of said tubes and said second passages defining said second injectors.

2. An axially staged combustion system as set out in claim 1, wherein each of said first and second passages has a diameter of from about 0.5 cm to about 2 cm.

3. An axially staged combustion system as set out in claim 1, wherein said main body unit is formed from a nickel-based material.

4. An axially staged combustion system as set out in claim 1, wherein a ratio of a number of said first passages to a number of said second passages is from about 2/1 to about 6/1.

5. An axially staged combustion system as set out in claim 1, wherein each first passage in a set of said first passages has a first center axis and a first diameter and one of said second passages positioned adjacent to said set of first passages has a second center axis and a second diameter, wherein a distance between said first and second center axes is within a range of about two times said first diameter to about four times said first diameter.

6. An axially staged combustion system as set out in claim 1, further comprising cooling structure to cool said tubes of said second injectors.

7. An axially staged combustion system as set out in claim 1, wherein said second structure provides fuel to said second injectors concurrently with said first structure providing fuel to said first injectors.

8. An axially staged combustion system as set out in claim 1, wherein a ratio of a diameter of at least one of said second passages to a diameter of said main body unit is in a range from about 10:1 to about 120:1.

9. An axially staged combustion system as set out in claim 8, wherein a ratio of a diameter of at least one of said second passages to a diameter of said main body unit is in a range from about 20:1 to about 50:1.

10. An axially staged combustion system as set out in claim 9, wherein a ratio of a diameter of at least one of said second passages to a diameter of said main body unit is in a range from about 30:1 to about 40:1.

11. An axially staged combustion system for a gas turbine engine comprising:

a main body structure having a plurality of first injectors and a plurality of second injectors, compressed air being provided to at least one of said first injectors;

first structure to provide fuel to said at least one of said first injectors, said fuel provided to said at least one of said first injectors being adapted to mix with the compressed air provided to said at least one of said first injectors and ignite to produce a flame such that the flame associated with said at least one of said first injectors defines a flame front that is axially spaced from a reference surface of said main body structure;

each of said second injectors comprising a section extending from said reference surface of said main body structure and positioned such that fuel or a combination of air and fuel exits said second injectors a first axial location where a mixture of compressed air and fuel exits said first injectors, wherein the first axial location is at the reference surface; and second structure to provide fuel to at least one of said second injectors, said fuel passing through said at least one of said second injectors and exiting said at least one of said second injectors at a second axial location downstream of the first axial location such that the fuel exiting said at least one of said second injectors mixes with air and ignites at a third axial location downstream of the second axial location;

wherein said second structure provides fuel to said one of said second injectors at a positive rate such that the fuel mixes with air to create a fuel and air mixture richer than a fuel and air mixture resulting from a positive rate at which fuel is provided to said at least one of said first injectors by said first structure, wherein a first one of said second injector sections has a first length and a second one of said second injector sections has a second length which is different from said first length.

12. An axially staged combustion system for a gas turbine engine comprising:

a main body structure having a plurality of first injectors and a plurality of second injectors, compressed air being provided to at least one of said first injectors;

first structure to provide fuel to said at least one of said first injectors, said fuel provided to said at least one of said first injectors being adapted to mix with the compressed air provided to said at least one of said first injectors and ignite to produce a flame such that the flame associated with said at least one of said first injectors defines a flame front that is axially spaced from a reference surface of said main body structure;

each of said second injectors comprising a section extending from said reference surface of said main body structure and positioned such that fuel or a combination of air and fuel exits said second injectors a first axial location where a mixture of compressed air and fuel exits said first injectors, wherein the first axial location is at the reference surface; and second structure to provide fuel to at least one of said second injectors, said fuel passing through said at least one of said second injectors and exiting said at least one of said second injectors at a second axial location downstream of the first axial location such that the fuel exiting said at least one of said second injectors mixes with air and ignites at a third axial location downstream of the second axial location;

wherein said second structure provides fuel to said one of said second injectors at a positive rate such that the fuel mixes with air to create a fuel and air mixture richer than a fuel and air mixture resulting from a positive rate at which fuel is provided to said at least one of said first injectors by said first structure, wherein a first one of said second injectors has a first diameter and a second one of said second injectors has a second diameter different from said first diameter.

13. An axially staged combustion system as set out in claim 11, wherein second structure provides fuel to each of said second injectors, said fuel passing through said second injectors and exiting each of said second injectors at the second axial location such that said fuel exiting each of said second injectors mixes with air and ignites at the third axial location, wherein said fuel from each of said second injectors is ignited in a common flame chamber defined in said main body structure.

14. An axially staged combustion system as set out in claim 12, wherein second structure provides fuel to each of said second injectors, said fuel passing through said second injectors and exiting each of said second injectors at the second axial location such that said fuel exiting each of said second injectors mixes with air and ignites at the third axial location, wherein said fuel from each of said second injectors is ignited in a common flame chamber defined in said main body structure.

* * * * *

UNITED STATES PATENT AND TRADEMARK OFFICE

CERTIFICATE OF CORRECTION

PATENT NO. : 7,631,499 B2
APPLICATION NO. : 11/498480
DATED : December 15, 2009
INVENTOR(S) : Robert J. Bland It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 314 days.

Signed and Sealed this

Second Day of November, 2010

David J. Kappos

David J. Kappos
*Director of the United States Patent and Trademark Office*